US006298784B1

(12) United States Patent
Knowlton et al.

(10) Patent No.: US 6,298,784 B1
(45) Date of Patent: Oct. 9, 2001

(54) HEAT TRANSFER DELAY

(75) Inventors: Gregory D. Knowlton, Chandler, AZ (US); Bruce B. Anderson, Tempe, AZ (US); Theodore B. Gortemoller, Shalimar, FL (US)

(73) Assignee: Talley Defense Systems, Inc., Mesa, AZ (US)

( * ) Notice: Subject to any disclaimer, the term of this patent is extended or adjusted under 35 U.S.C. 154(b) by 44 days.

(21) Appl. No.: 09/428,329

(22) Filed: Oct. 27, 1999

(51) Int. Cl.[7] ..... C06C 5/04; C06C 9/00
(52) U.S. Cl. ..... 102/275.3; 102/205
(58) Field of Search ..... 102/275.3, 205

(56) References Cited

U.S. PATENT DOCUMENTS

| | | | | |
|---|---|---|---|---|
| 2,429,490 | | 10/1947 | Scherrer | 102/28 |
| 2,506,157 | | 5/1950 | Loret | 102/28 |
| 3,727,552 | | 4/1973 | Zakheim | 102/27 R |
| 3,999,484 | | 12/1976 | Evans | 102/28 R |
| 4,358,998 | | 11/1982 | Schneiter et al. | 102/530 |
| 5,593,181 | | 1/1997 | Walker et al. | 280/741 |
| 5,739,460 | * | 4/1998 | Knowlton et al. | 102/324 |
| 5,959,242 | * | 9/1999 | Knowlton et al. | 149/38 |
| 6,101,947 | * | 8/2000 | Knowlton et al. | 102/288 |

* cited by examiner

*Primary Examiner*—Peter M. Poon
*Assistant Examiner*—Aileen J. Baker

(57) ABSTRACT

A heat transfer delay for providing a delay time in propellant, pyrotechnic, and explosive devices, and a method of delaying production of a non-detonating thermal output with the heat transfer delay. A representative delay is in the form of a housing having a first heat source cavity, a second heat source cavity, and a heat transfer cavity connecting the first and second heat source cavities. A pyrotechnic heat source is placed in thermal contact with the first heat source cavity, and a non-detonating autoignition material is placed in thermal contact with the second heat source cavity. Upon ignition and combustion or reaction, the pyrotechnic heat source generates an amount of heat sufficient to heat the first heat source cavity to a temperature sufficiently high to cause a transfer of a sufficient amount of heat through the heat transfer cavity to the second heat source cavity to heat it to a temperature sufficiently high to ignite the non-detonating autoignition material, and produce a non-detonating thermal output therefrom, where the heat transfer bridge conducts heat at a rate such that a delay time of at least about 0.5 second elapses between ignition of the heat source and ignition of the non-detonating autoignition material.

27 Claims, 7 Drawing Sheets

HEAT TRANSFER DELAY

FIELD OF THE INVENTION

The present invention is directed to delays that reliably and precisely control the time to function for propellant, pyrotechnic, and explosive devices. In particular, the present invention is directed to delays that utilize heat transfer to act as a thermal switch.

BACKGROUND OF THE INVENTION

Various pyrotechnic, electronic, and mechanical delays that control the time to function of propellant, pyrotechnic, and explosive devices are known in the art. Pyrotechnic delays are frequently used to control functions of munitions, such as self-destruct and self-disable, and the propellant ignition time of a rocket or rocket assisted projectile, where the timing of the ignition of the propellant is critical in achieving maximum range. Pyrotechnic delays generally rely on the controlled burning of a pyrotechnic material, acting essentially as a fuse, such that the length of the column of pyrotechnic material and the burning rate of the material determine the time of the delay. That is, the delay time is the time between the ignition of the pyrotechnic column and the ignition of the propellant, pyrotechnic, and explosive device by the heat and/or flame output generated by the combustion of the pyrotechnic column. For example, in a projectile having a range extending propellant, the initial end of a pyrotechnic delay column/ignition train is ignited as the shell is fired. The range extending propellant grain is then ignited by the heat and/or flame output of the pyrotechnic delay column/ignition train when the burning portion of the delay column/ignition train reaches the propellant. The delay time is then the time between the ignition of the pyrotechnic delay column/ignition train and the ignition of the range extending propellant grain by the output of the pyrotechnic delay column/ignition train.

Pyrotechnic delays typically require a rapid burn rate for reliability. Slower burning pyrotechnics are harder to ignite than fast burning pyrotechnics, and, typically, do not burn at a constant rate. Therefore, the delay time of slow burning pyrotechnics is less reliable than faster burning pyrotechnic delays, and reliable longer delay times are not easily obtained.

Control of the delay time of reliable, fast burning pyrotechnic delays is achieved by determining the burn rate of the pyrotechnic material and the length of pyrotechnic material that is needed to burn for the required time. As a result, the use of pyrotechnic delays in timing munition events is primarily limited by the space requirements of the munition, i.e., by the length of the column that will fit in the munition. Therefore, extended delay times are difficult to achieve because of the excessive length of pyrotechnic material required and/or the need for a slow burning pyrotechnic material. Typical size limitations for pyrotechnic delays using bum rate and column length to control the delay are driven by a nominal lower bum rate of about 0.1 inch (2.5 mm) per second for pyrotechnic columns having a cross section of about ⅛ inch (3 mm) for columns up to about ⅜ inch (9.1 mm), with cross-sections of about ¼ inch (6.4 mm) for longer columns. The burn rate, heat loss, and column cross section are all closely interrelated, and, thus, the column must be carefully tailored to obtain reliable performance at or near the limits described above.

Electronic delays are typically used in situations where pyrotechnic delays are inadequate. The requirements for the self-destruction of munitions dictates long delay times, i.e., in excess of 30 seconds. For long delay times, electronic delay mechanisms are typically utilized because pyrotechnics cannot provide the delay time required within the packaging constraints. For time delays greater than 30 seconds, electronic delays offer greater packaging efficiency than pyrotechnic delays, but at a significant cost premium. In addition, electronic delays are much less durable than pyrotechnic delays, being comparatively fragile and, thus, susceptible to damage by the high acceleration or "g" loading experienced when the projectile is fired or the munition is launched or ejected.

Mechanical delays are less common for timing munitions because of their poor reliability. In particular, pre-wound spring mechanisms fatigue over time, and complex winding or other energizing mechanisms are inherently less reliable.

Although unique pyrotechnic delays that utilize heat transfer through various media to provide a thermal output with a short delay time, i.e., less than about 0.5 seconds, are known in the art, there is no known disclosure of pyrotechnic delays having a non-detonating thermal output that are capable of providing a reliable delay time of greater than 0.5 seconds. For example, U.S. Pat. No. 2,506,157 to Loret discloses a delay action blasting cap that allows a series of blasting caps to be produced having delays that differ one from another by small fractions of a second. The delay action blasting cap comprises an ignition charge in intimate contact with one end of a piece of heat conducting incombustible material, having an explosive fulminating element, i.e., a primary explosive that detonates upon ignition, at the end opposite the ignition charge. Upon combustion of the ignition charge, heat is transferred to, and travels through the piece of heat conducting material. The transfer of heat through the heat conducting material to the fulminating element causes the fulminating element to detonate, resulting in the detonation of the output charge. The amount of time required for the heat to travel from the ignition charge, through the heat conducting material to the fulminating element, causing the fulminating element to detonate, is the delay time of the blasting cap. However, the detonating output of such a delay is not as practical for initiating a propellant or pyrotechnic device that requires a heat and/or flame output.

U.S. Pat. No. 2,429,490 to Scherrer discloses detonators having delay times of from about 5 to about 30 milliseconds (ms). The delay is obtained by placing a thin metal disk, e.g., about 0.0015 inch thick, between a heating charge and a detonating charge. Heat generated by the combustion of the heating charge is rapidly transmitted through the disk to initiate the detonating charge after a short delay.

U.S. Pat. No. 3,727,552 to Zakheim discloses a bidirectional delay connector comprising a shell containing a separate detonating charge adjacent to each end of the connector, where the ends are adapted to receive a detonating fuse. Each detonating charge is also in close proximity to an exothermic charge at an end of a centrally located metal relay capsule, where a heat-conductive metallic delay element is positioned between each heat sensitive charge and the relay capsule containing the exothermic charges. Delay times on the order of 200 ms are produced.

U.S. Pat. No. 3,999,484 to Evans discloses a delay device having a dimpled transfer disc positioned between a delay charge and an output explosive charge. The delay time of 20 ms to 20 s is provided by the burning time of the delay charge. The disc, which is typically only about 0.01 inch thick, contributes little to the overall delay time.

U.S. Pat. Nos. 4,358,998 and 5,593,181 to Schneider et al. and Walker et al., respectively, disclose igniters for pyrotechnic gas bag inflators for vehicles, where short delays on the order of a few milliseconds are required.

Therefore, as a result of a new emphasis on munition self-destruct or disable ("SD"), a need exists for a small, reliable, low cost delay mechanism having a non-detonating thermal output. The present invention provides such a delay.

SUMMARY OF THE INVENTION

The present invention is directed to a heat transfer delay for providing a delay time in propellant, pyrotechnic, and explosive devices. The delay comprises a housing, comprising a first heat source cavity and a second heat source cavity, and a heat transfer bridge connecting the first and second heat source cavities; a pyrotechnic heat source in thermal contact with the first heat source cavity, and a non-detonating autoignition material in thermal contact with the second heat source cavity. Upon ignition and combustion or reaction, the pyrotechnic heat source generates an amount of heat sufficient to heat the first heat source cavity to a temperature sufficiently high to cause a transfer of a sufficient amount of heat through the heat transfer bridge to the second heat source cavity to heat it to a temperature sufficiently high to ignite the non-detonating autoignition material, and produce a non-detonating thermal output therefrom, where the heat transfer bridge conducts heat at a rate, such that a delay time of at least about 0.5 second elapses between ignition of the heat source and ignition of the non-detonating autoignition material. By varying at least one parameter, such as, e.g., the cross sectional area, length, and thermal conductivity of the heat transfer bridge, the amount and heat of reaction of the pyrotechnic heat source, and/or the autoignition temperature of the non-detonating autoignition material, the delay time can be adjusted to a desired duration, such as, e.g., at least 0.5, 1, 2, 5, 10, 15, 20, 30, 60, 90 seconds, or longer.

The autoignition material useful in the heat transfer delay is preferably non-detonating, and may be nitrocellulose, nitroglycerine based smokeless gun powders, safety and strike anywhere match compositions, smoke compositions, friction primer compositions, plastic bonded starter compositions, white smoke compositions, sugar based compositions, diazidodinitrophenol (DDNP) compositions, mixtures of an oxidizer composition and a powdered metal fuel, and mixtures thereof. Preferably, the non-detonating autoignition material comprises a mixture of an oxidizer composition and a powdered metal fuel, where the oxidizer composition is selected from the group consisting of alkali metal nitrates, alkaline earth metal nitrates, complex salt nitrates, dried, hydrated nitrates, silver nitrate, alkali metal chlorates, alkali metal perchlorates, alkaline earth metal chlorates, alkaline earth metal perchlorates, ammonium perchlorate, sodium nitrite, ammonium nitrate, potassium nitrite, silver nitrite, complex salt nitrites, solid organic nitrates, solid organic nitrites, solid organic amines, and mixtures and comelts thereof. Most preferably, the oxidizer composition is selected from the group consisting of silver nitrate, and mixtures and comelts of at least one of silver nitrate or ammonium nitrate and at least one of alkali metal nitrates, alkaline earth metal nitrates, ammonium nitrate, complex salt nitrates, dried, hydrated nitrates, alkali metal chlorates, alkali metal perchlorates, alkaline earth metal chlorates, alkaline earth metal perchlorates, ammonium perchlorate, nitrites of sodium, nitrites of potassium, nitrites of silver, solid organic nitrates, solid organic nitrites, and solid organic amines. The powdered metal fuel is preferably selected from the group consisting of molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, silicon, and mixtures thereof, and is most preferably molybdenum.

Representatives of the non-detonating autoignition material include mixtures of potassium nitrate, silver nitrate, and molybdenum; guanidine nitrate, silver nitrate, and molybdenum; silver nitrate, potassium nitrate, guanidine nitrate, fused silica, and molybdenum; lithium nitrate, guanidine nitrate, ammonium perchlorate, fused silica, and molybdenum; ammonium nitrate, guanidine nitrate, and molybdenum; mixtures of ammonium nitrate, guanidine nitrate, nitroguanidine, and molybdenum; mixtures of ammonium nitrate, tetramethylammonium nitrate, and molybdenum; mixtures of ammonium nitrate, guanidine nitrate, tetramethylammonium nitrate, and molybdenum; mixtures of ammonium nitrate, 5-aminotetrazole, potassium chlorate, and molybdenum; mixtures of ammonium nitrate, 5-aminotetrazole, potassium perchlorate, and molybdenum; mixtures of ammonium nitrate, barbituric acid, potassium chlorate, and molybdenum; and mixtures of ammonium nitrate, barbituric acid, potassium perchlorate, and molybdenum.

The pyrotechnic heat source may be a thermite, thermate, delay composition, halogenated composition, torch/flare composition, igniter composition, intermetallic composition, or mixtures thereof.

Useful housing materials include any material that will conduct heat from the pyrotechnic heat source to the autoignition material, including, but not limited to metals, alloys, ceramics, aluminas, silicas, alumina silicates, alumina borates, alumina silica borates, alumina nitrides, beryllias, carbides, composites, fiberglass, and graphite.

Preferably, the heat transfer bridge serves as a thermal choke having a cross sectional area and a thermal conductivity that control the transfer of heat from the first heat source cavity to the second heat source cavity of the housing, the first heat source cavity defines a portion of the housing for containing the heat source, and the second heat source cavity defines a portion of the housing for containing a non-detonating autoignition material. In addition, to reduce or eliminate a loss of heat from the housing, an insulating material at least partially surrounding the housing may be used. Useful insulating materials include, but are not limited to, ceramics, filled epoxies, glasses, composites, paints, laminates, non-heat-conductive polymers, expanded polytetrafluoroethylene (PTFE), such as GORE-TEX® and TEFLON®, natural and synthetic rubbers, urethanes, and heat resistant composites, where glass tape, polyethylene, an epoxy resin, expanded TEFLON®, or PTFE are preferred.

The invention is also directed to a method of delaying production of a non-detonating thermal output using the heat transfer delay of the invention. The method comprises placing a heat transfer medium, which may be insulated, in thermal contact with a pyrotechnic heat source and a non-detonating autoignition material. The pyrotechnic heat source is ignited, thereby producing heat from combustion or reaction of the pyrotechnic heat source. At least a portion of the heat of reaction is transferred to the heat transfer medium, and at least a portion of this heat is conducted through the heat transfer medium to the non-detonating autoignition material, raising the temperature of the non-detonating autoignition material with the heat to at least the autoignition temperature of the material, and, thus, igniting the non-detonating autoignition material, and producing a non-detonating thermal output due to the ignition. Preferably, the heat transfer medium conducts heat at a rate such that a delay time of at least about 0.5 seconds elapses between ignition of the heat source and ignition of the non-detonating autoignition material. At least one of the cross sectional area, length, and thermal conductivity of the heat transfer portion, the amount and heat of reaction of the pyrotechnic heat source, the autoignition temperature of the non-detonating autoignition material may be varied to adjust the delay time to a desired duration.

DETAILED DESCRIPTION OF THE INVENTION

Figure 1:
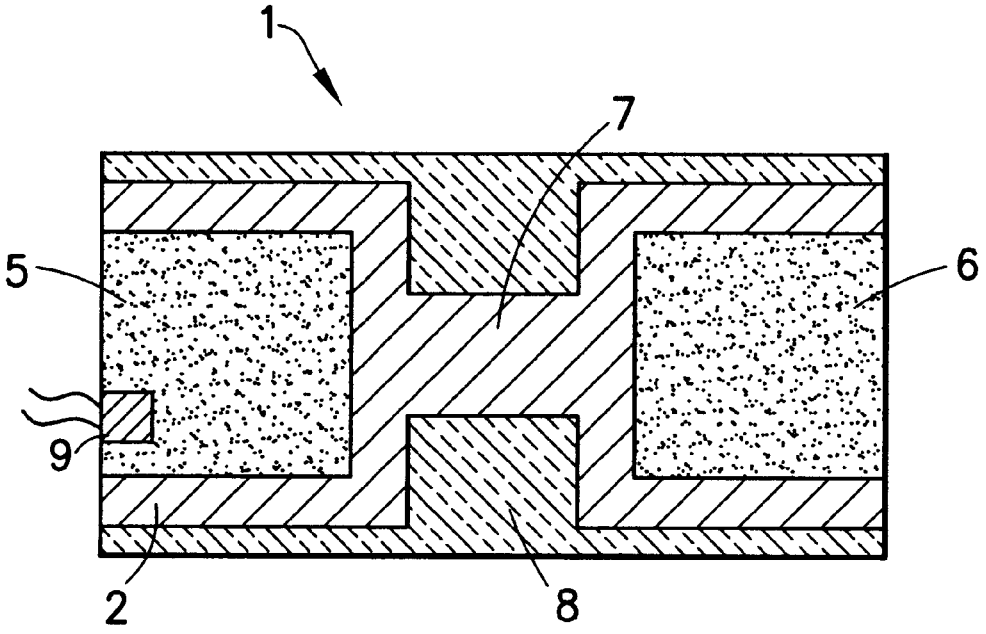
FIG. 1 is a cross sectional illustration of a heat transfer delay of the invention.

As used herein, the terms "detonate" and "detonation" refer to the explosive combustion or decomposition of a primary explosive, such as lead azide or fulminate of mercury, where the combustion or decomposition reaction exceeds the speed of sound, creating a shock wave, and resulting in an explosion whether the explosive is confined or not.

Therefore, as used herein, the term "non-detonating" refers to the combustion, reaction, or decomposition of a pyrotechnic material, where the combustion, reaction, or decomposition reaction does not exceed the speed of sound, so that a shock wave is not produced, and an explosion does not occur. Instead, the non-detonating combustion or decomposition of a pyrotechnic material will produce at least one of heat (i.e., thermal energy), gas, or flame, and will only cause an explosion when confined, where an increase in pressure within the container that confines the material causes the container to explode.

Furthermore, as used herein, the terms "non-detonating output" and "non-detonating thermal output" refer to a non-explosive release of at least one of heat, gas, or flame from the combustion, reaction, or decomposition of a "non-detonating material", i.e., a material that does not detonate on combustion, reaction, or decomposition. However, a non-detonating output may be used to cause the detonation of a material that will detonate when exposed to heat or flame.

In addition, as used herein, the term "cavity" refers to any means for holding or positioning a pyrotechnic heat source or autoignition material within the heat transfer delay of the invention, and a "tube" is any hollow elongated structure, which may have any cross sectional shape, and may be straight or curved along it length.

The present invention is directed to a heat transfer delay ("HTD") that is suitable for use invarious delay applications, typically for controlling the delay time, e.g., the time to function, of pyrotechnic, propellant, and explosive devices, including munitions, rocket propellants, and blasting devices, such as blasting caps. The heat transfer delay of the invention is a small, low cost, highly reliable delay mechanism that is superior to prior art delays. In some ways the heat transfer delay of the invention and prior art pyrotechnic delays function in a similar manner, i.e., ignition, combustion or reaction of a pyrotechnic material, followed by the ignition, combustion, decomposition, or cook-off of an output charge or autoignition material ("AIM"). However, the apparent similarity is only superficial.

The pyrotechnic delay device of the invention provides a number of advantages over typical delay devices currently in use. For example, mission requirements for the self destruction of munitions have extended the required delay times to 30 seconds or longer. It is not generally feasible to attain such long delay times with prior art pyrotechnic delays because the space required for such delays would exceed packaging constraints. Moreover, electronic delays are costly and inherently less reliable because of their fragility. Mechanical delays also suffer from reliability problems.

The heat transfer delay of the invention, which typically has three main components and no moving parts, is simpler and less expensive to manufacture than prior art delays. In addition, the components of the heat transfer delay can be adjusted to attain a wide range of delay times, and can be tied into the normal functioning of a munition to attain complete self-destruct, not just self-disable. Similar advantages are available for any system requiring a compact delay having a long function time.

In contrast to prior art pyrotechnic delays, the time delay of a heat transfer delay does not depend on solely the bum rate and the column length of a pyrotechnic material, but, instead, is controlled by the time required to transfer the heat generated from a burning pyrotechnic material across a control medium (bridge) to an autoignition material to increase the temperature of the autoignition material to or above its autoignition temperature, resulting in the ignition of the autoignition material.

Figure 2:
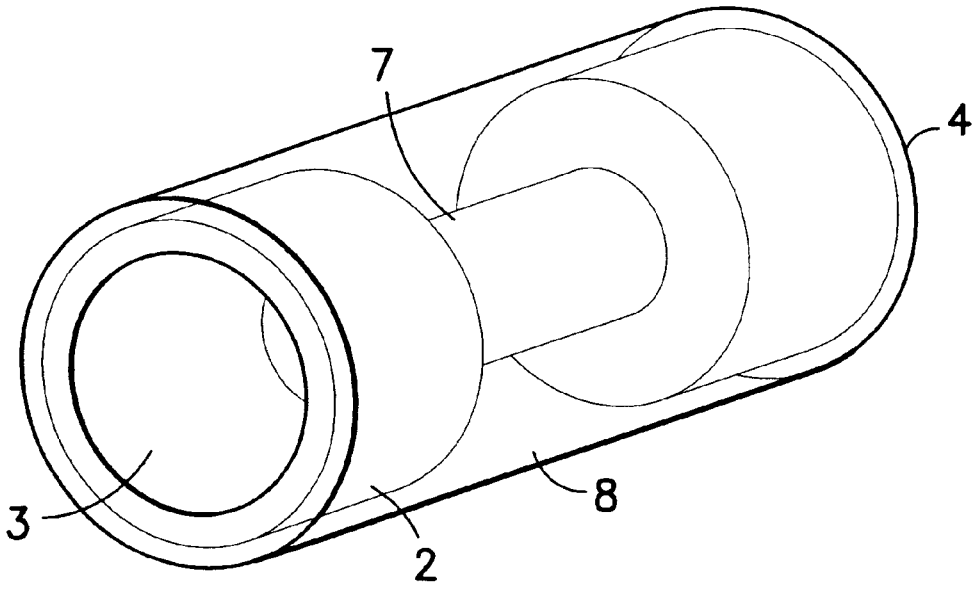
FIG. 2 is a perspective drawing of a heat transfer delay of the invention.

The heat transfer delay of the invention typically comprises three components, a pyrotechnic heat source in thermal contact with a heat transfer control medium that, in turn, is in thermal contact with an autoignition material. Although the heat transfer delay of the invention may take on any configuration that provides a reliable, easily predetermined delay time, one embodiment of a simple heat transfer delay may be obtained using the configuration shown in FIGS. 1 and 2. As shown in FIGS. 1 and 2, the illustrated heat transfer delay, 1, comprises a housing, 2, formed from a heat transfer control medium, which may be a metal, alloy, ceramic, or any other suitable material, and defines cavities, 3 and 4, into which a pyrotechnic heat source, 5, which is typically a high heat output pyrotechnic composition, and an autoignition material, 6, which is preferably non-detonating, are placed. Heat from the pyrotechnic heat source, 5, is transferred to the autoignition material, 6, through a thermal choke, 7, or heat transfer control bridge, which is part of the heat transfer control medium. Preferably, the housing, 2, is surrounded by an insulating material, 8, to prevent heat loss. An appropriate ignition source, 9, of any type well known in the art, including, but not limited to, an electric match, hot wire, or squib, is placed in thermal contact with the pyrotechnic heat source, 5, to provide the required initiation of the delay.

The heat transfer delay of the invention functions as follows: the pyrotechnic heat source, 5, is ignited by using the ignition source, 9. Heat from the combustion or reaction of the pyrotechnic heat source, 5, is transmitted through the thermal choke, 7, to the autoignition material, 6, which is heated to its autoignition temperature, and ignites. Upon ignition, the output of the autoignition material, 6, may be used to initiate the functioning of a variety of devices, including, but not limited to a munitions primary initiation system or disable mechanism, or to initiate a variety of propellant, pyrotechnic, and explosive devices or systems.

Figure 3:
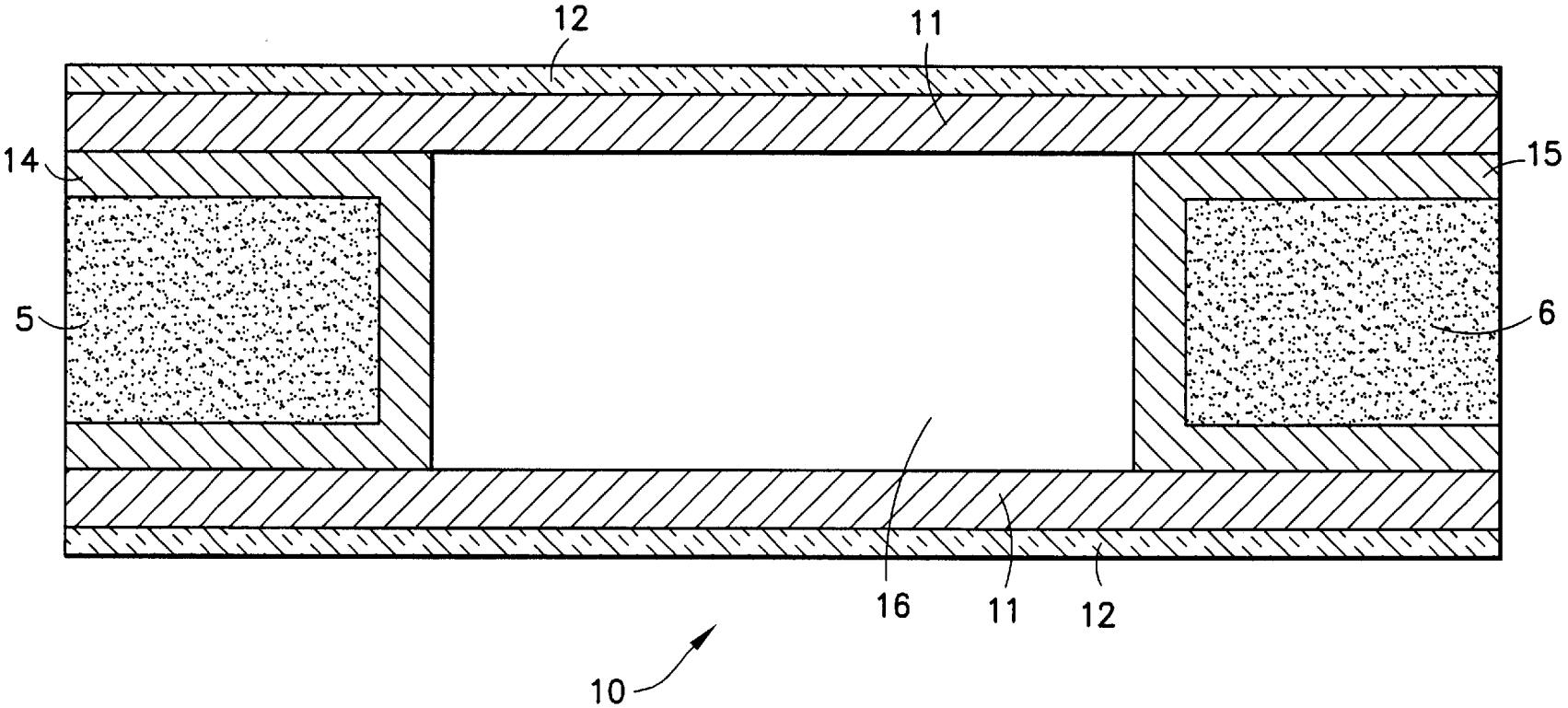
FIG. 3 is a cross sectional illustration of a heat transfer delay of the invention.

Further embodiments of the heat transfer delay of the invention are depicted in FIGS. 3 to 6. As shown in FIG. 3, a delay 10 in accordance with the invention may comprise a thermally conductive tube 11, which functions as both the housing and the heat transfer control bridge, and, optionally is covered on its outer surface with an insulation material 12. Positioned in each end of the tube 11 is a preformed cup, formed from a thermally conductive material. The preformed cups 14 and 15 are separated by air space 16, which, in part, determines the delay time. As with the delay illustrated in FIG. 1, one of the cups 14 contains a pyrotechnic heat source 5, which, when ignited, produces heat, which is transmitted through the cup 14 and thermally conductive tube 11 to the second cup 15, heating the non-detonating autoignition material 6 to its autoignition temperature, igniting the autoignition material 6. The delay time of delay 10 is determined by the heat of reaction of the pyrotechnic heat source 5, the amount of heat source material, the thermal conductivity of tube 11 and cups 14 and 15, and the autoignition temperature of autoignition material 6.

Figure 4:
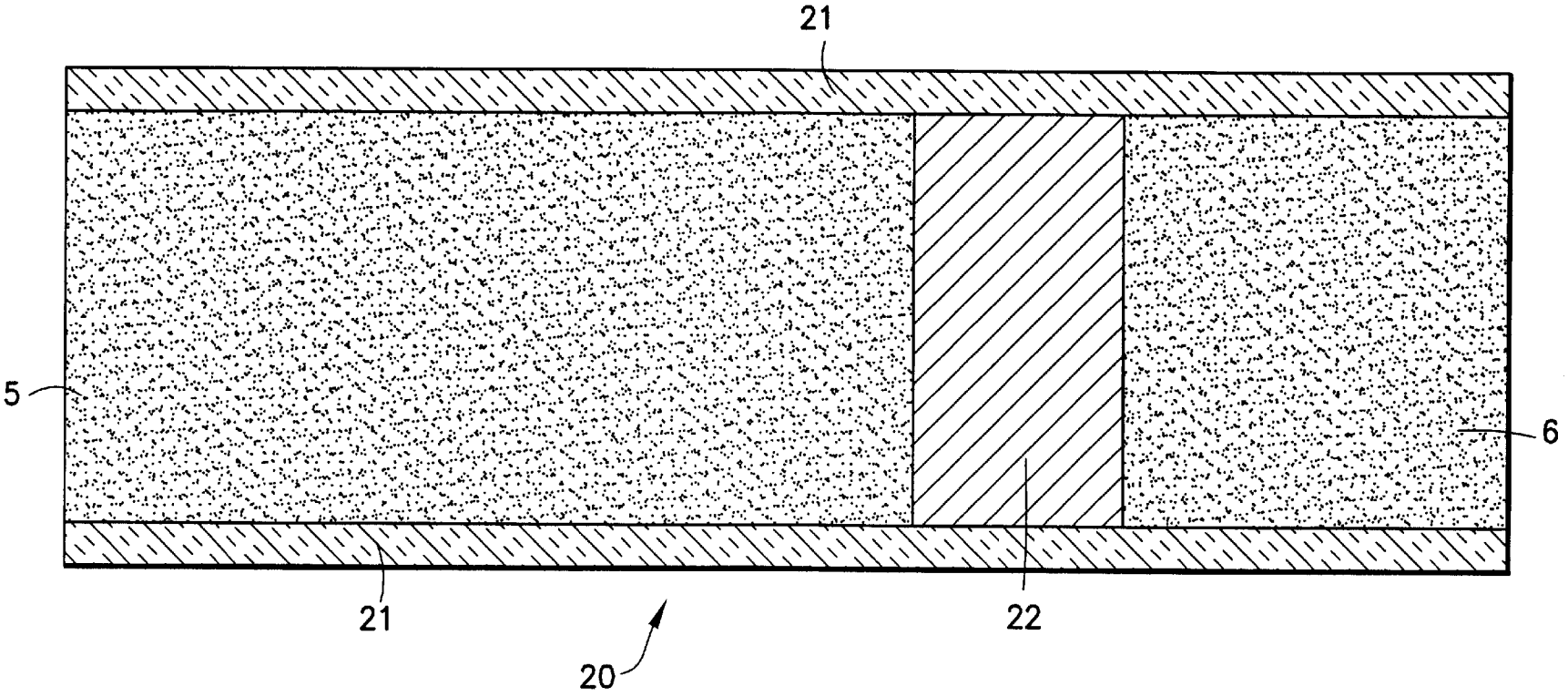
FIG. 4 is a cross sectional illustration of a heat transfer delay of the invention.

FIG. 4 shows a delay 20 comprising a tube of insulation material 21, a plug of thermally conductive material 22 situated within the tube 21, separating a pyrotechnic heat source 5 and a non-detonating autoignition material 6. Upon ignition of the heat source 5, heat is transmitted through the plug 22 to the autoignition material 6, heating the autoignition material to its autoignition temperature, causing the autoignition material to ignite.

Figure 5:
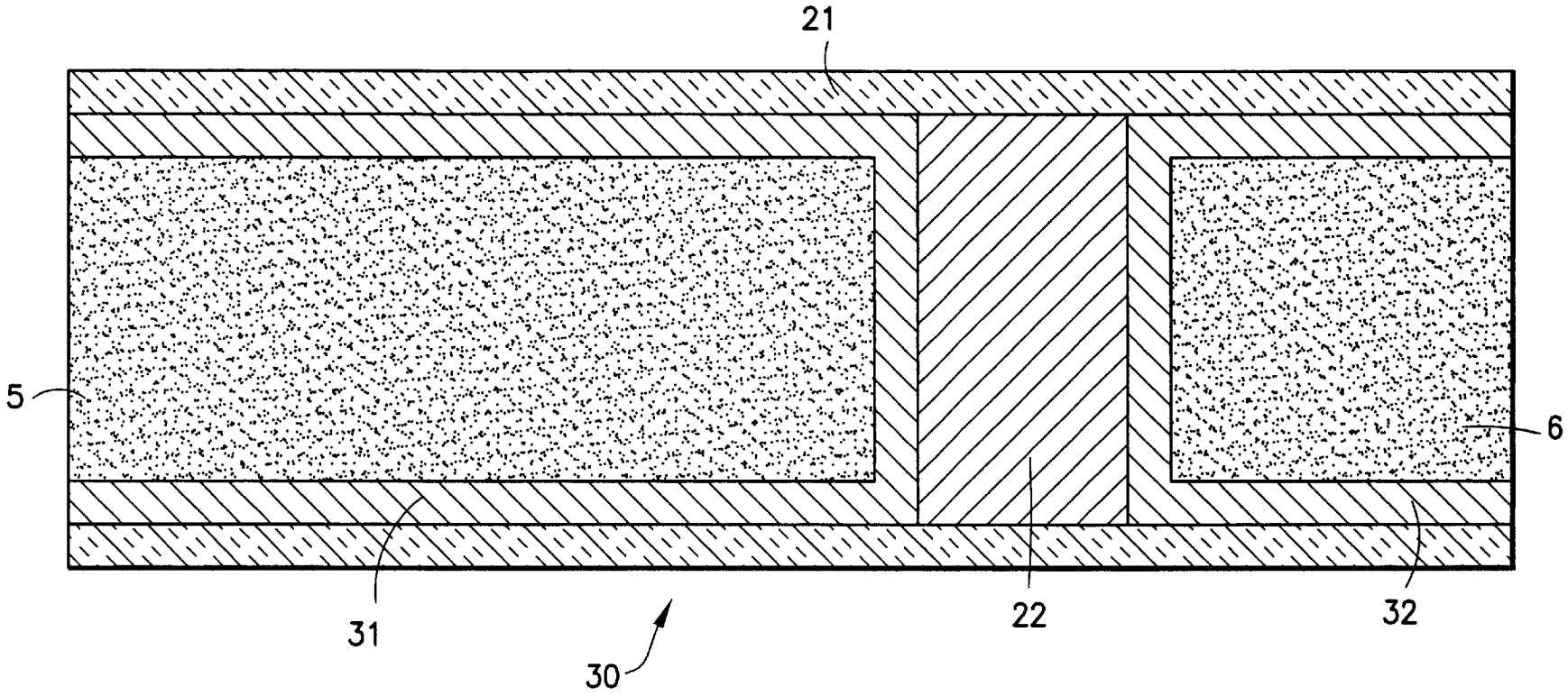
FIG. 5 is a cross sectional illustration of a heat transfer delay of the invention.

Delay 30, as shown in FIG. 5, is similar to the delay shown in FIG. 4 except that the pyrotechnic heat source 5 and autoignition material 6 are placed in preformed, thermally conductive cups 31 and 32, respectively, which are inserted into a tube of insulation material 21, such that the cups 31 and 32 are separated by and in thermal contact with a plug of thermally conductive material 22. When the pyrotechnic heat source 5 is ignited, the heat generated is transmitted through cup 31, plug 22, and cup 32, heating autoignition material 6 to its autoignition temperature, causing autoignition material 6 to ignite. The delay time of delay 30 is determined by the heat of reaction and the amount of pyrotechnic heat source material 5, the thermal conductivity and thickness of cups 31 and 32 and of plug 22, and the autoignition temperature of autoignition material 6.

Figure 6:
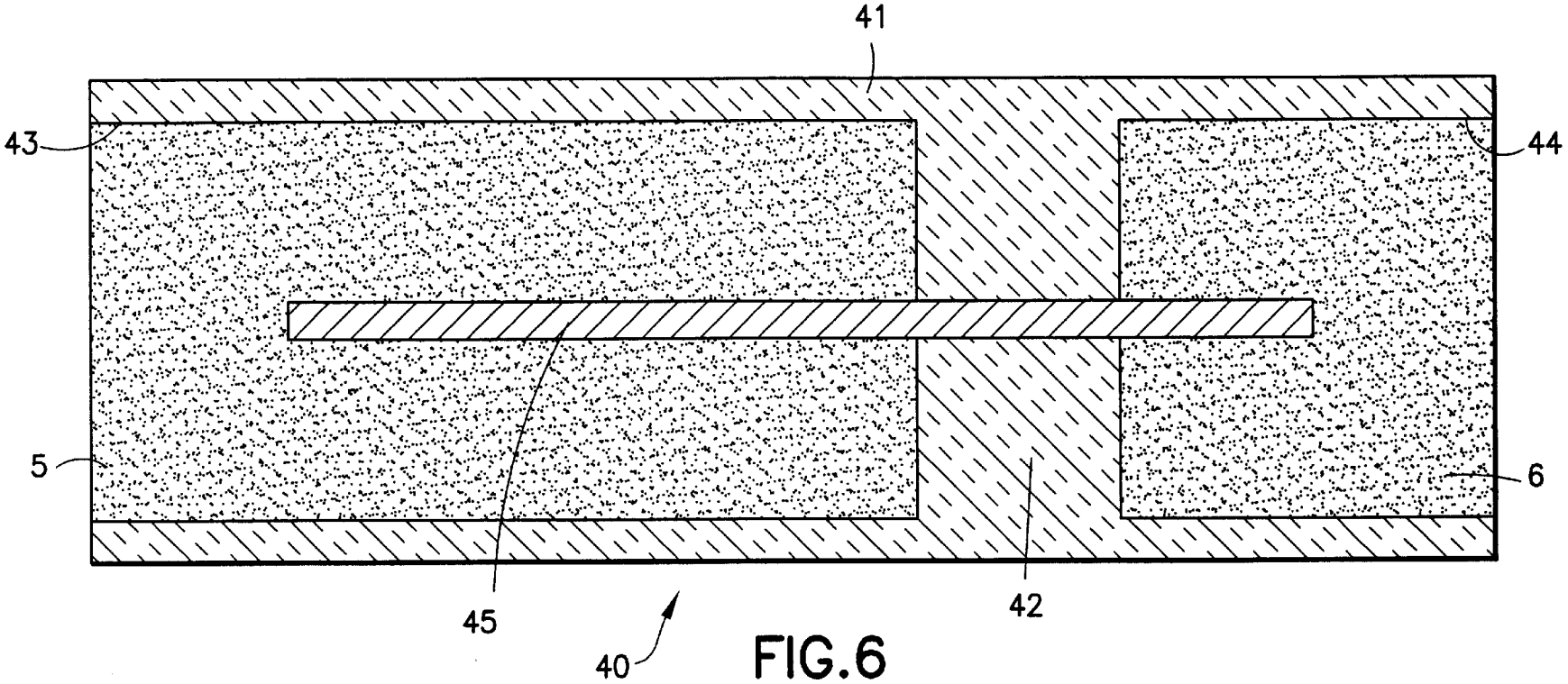
FIG. 6 is a cross sectional illustration of a multiple-functioning heat transfer delay of the invention.

The delay 40, as shown in FIG. 6, comprises an outer tube of insulation material 41 and a plug of insulation material 42, which may be a separate piece of material, inserted into tube 41, or may be formed of a single piece with tube 41. The tube 41 and the plug 42 form two cavities 43 and 44, which contain the pyrotechnic heat source 5 and autoignition material 6. A rod 45 of a thermally conductive material is situated in plug 42, such that one portion of rod 45 is in thermal contact with the heat source 5 and another portion is in thermal contact with the autoignition material 6. When the heat source 5 is ignited, heat is transmitted through the rod 45, heating the autoignition material 6 to its autoignition temperature, igniting the autoignition material 6. The delay time of delay 40 is determined by the heat of reaction and the amount of pyrotechnic heat source material 5, the thermal conductivity and thickness of rod 45, the thickness of plug 42, and the autoignition temperature of autoignition material 6.

The pyrotechnic heat source may be any pyrotechnic material capable of producing the required amount of heat. Pyrotechnic heat sources include any and all materials that produce heat through a chemical reaction. Pyrotechnic heat sources are categorized by the type of chemical reactions that each undergoes. Useful pyrotechnic heat sources are well known in the art, and include, but are not limited to, thermites, thermates, delay compositions, halogenated compositions, torch/flare compositions, igniter compositions, and intermetallic compositions. See, Ellern, *Military and Civilian Protechnics*, Chemical Publishing Company Inc., 1968.

Those pyrotechnic materials that generate heat through the reaction of a metal ($M_1$) with a metal oxide ($M_2O$) are generally referred to as thermites, where the reaction may be represented by:

$$M_1+M_2O \rightarrow M_2+M_1O.$$

It is important to note that $M_1$, $M_2$, $M_1O$, or $M_2O$ in this expression does not represent the stoichiometry of the reaction but, instead, represent any metal or metal oxide, such as Fe, Cu, $Fe_2O_3$, or CuO. The formulas and properties of some representative thermites are provided in TABLE 1 for illustration purposes only.

TABLE 1.

REPRESENTATIVE THERMITE COMPOSITIONS.

| Formula (%, wt/wt) | Theoretical Flame Temperature (C°) | Heat of Reaction (cal/g) | Heat Density (cal/cm$^3$) | Pressed Density (g/cm$^3$) |
|---|---|---|---|---|
| 27.3 Al + 72.7 $MoO_3$ | 2980 | −1124 | −4279 | 381 |
| 43.7 Al + 56.3 $B_2O_3$ | 2054 | −781 | −1971 | 2.52 |
| 11.9 B + 88.1 $Fe_2O_3$ | 1792 | −590 | −2751 | 4.67 |
| 31.0 Ti + 69.0 $Fe_2O_3$ | 2341 | −612 | −3066 | 5.01 |
| 66.3 Zr + 33.7 $B_2O_3$ | 2300 | −437 | −1654 | 3.78 |
| 45.1 Zn + 54.9 CuO | 1927 | −496 | −3368 | 6.79 |

Pyrotechnic materials that generate heat through the reaction of a metal ($M_1$) with a metal oxide (M2O) in the presence of an additional, more energetic, oxidizer, such as potassium perchlorate (KP), $KClO_4$; sodium perchlorate, $NaClO_4$; sodium chlorate, $NaClO_3$; potassium nitrate (KN), $KNO_3$; sodium nitrate, $NaNO_3$; sodium dichromate, $Na_2$, $Cr_2O_7$; potassium dichromate, $K_2Cr_2O_7$; or potassium permanganate, $KMnO_4$; are generally referred to as thermates, where the reaction, with potassium perchlorate for example, may be represented by:

$$M_1+M_2O+KClO_4 \rightarrow M_2+M_1O+KCl.$$

Again, as noted above, $M_1O$ or $M_2O$ in this expression does not represent the stoichiometry, but, instead, represent any metal oxide such as $Fe_{2\ O3}$ or CuO. The formulas and properties of some representative thermates are provided in TABLE 2 for illustration purposes only.

TABLE 2.

REPRESENTATIVE THERMATE COMPOSITIONS.

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 30.8 Al + 35.3 $MoO_3$ + 33.9 KP | 3377 | −808 | −2700 | 3.34 |
| 37.7 Al + 20.8 $B_2O_3$ + 41.5 KP | 2630 | −696 | −1663 | 2.39 |
| 14.5 B + 45.8 $Fe_2O_3$ + 39.7 KP | 2219 | −512 | −1654 | 3.23 |
| 52.9 Ti + 25.2 $Fe_2O_3$ + 21.9 KP | 2845 | −555 | −2187 | 3.94 |
| 75.4 Zr + 8.2 $B_2O_3$ + 16.4 KP | 3222 | −442 | −1936 | 4.38 |
| 60.0 Zn + 14.6 CuO + 25.4 KP | 1874 | −262 | −1534 | 5.86 |

A pyrotechnic composition that burns at a reproducible rate, and is used to produce a time delay between initiation and output is generally referred to as a delay composition. Delay compositions are ideal candidates for the pyrotechnic heat source of the HTD, such as delay compositions comprising a metal fuel, such as molybdenum, tungsten, boron or tantalum, and a blend of oxidizers, such as a metal chromate, $M_1CrO_4$, and potassium perchlorate (KP), $KClO_4$ and often contain a binder, such as vinyl alcohol acetate resin (VAAR). The reaction of such a delay composition may be represented by:

$$M_1+M_2CrO_4 \rightarrow M_1O+M_2O+KCl+Cr_2O_3,$$

where, again, $M_1O$ or $M_20$ do not represent the stoichiometry, but, instead, represent any metal oxide, such as $Fe_2O_3$ or CuO. Formulas and properties of some representative delay compositions are provided in TABLE 3 for illustration purposes only.

TABLE 3.

REPRESENTATIVE DELAY COMPOSITIONS

| Formula (%, wt/wt) | Theoretical Flame Temperature (C°) | Heat of Reaction (cal/g) | Heat Density (cal/cm$^3$) | Pressed Density (g/cm$^3$) |
|---|---|---|---|---|
| 55.0 Mo + 40.0 $BaCrO_4$ + 5.0 $KClO_4$ | 1339 | −149 | −1123 | 7.53 |
| 55.0 Mo + 35.0 $NH_4$-$ClO_4$ + 10.0 $(NH_4)_2Cr_2O_7$ | 2168 | −419 | −2727 | 6.51 |
| 45.0 W + 40.5 $BaCrO_4$ + 14.5 $KClO_4$ | 1775 | −372 | −2135 | 5.74 |
| 44.5 Ta + 39.5 $BaCrO_4$ + 15.0 $KClO_4$ + 1.0 VAAR | 2567 | −310 | −1760 | 5.68 |
| 26.0 Zr/Ni (30/70 alloy) + 60.0 $BaCrO_4$ + 14.0 $KClO_4$ | 1340 | −521 | −2350 | 4.51 |
| 10.0 B + 89.0 $BaCrO_4$ + 1.0 VAAR | 1647 | −316 | −1293 | 4.11 |

Halogenated compositions, such as mixtures of magnesium and TEFLON® with VITON® or magnesium and TEFLON® with silicone, release energy from the fluorination of the metal. The general reaction equation for a stoichiometric mixture of 32.7 percent by weight Magnesium and 67.3 percent by weight TEFLON® is $$2nMg+(C_2F_4)_n \rightarrow 2nMgF_2+2nC,$$

where n is generally an integer. Similarly, when a VITON® ($C_{10}H_7F_{13}$) binder is added to the reaction/combustion, the reaction products are $MgF_2$, HF and C. Formulas and properties of some representative fluorinated compositions are provided in TABLE 4 for illustration purposes only.

TABLE 4.

REPRESENTATIVE HALOGENATED COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 65.0 Mg + 30.0 Teflon ® + 5.0 Viton ® A | 1650 | −1150 | −1955 | 1.70 |
| 37.0 Mg + 26.0 Teflon ® + 37.0 Silicone | 1593 | −632 | −904 | 1.43 |

Torch and flare compositions typically include magnesium as a fuel component, as magnesium burns hot and brightly, but may also use other metals as the fuel, such as titanium, zirconium and silicon. Compositions containing magnesium and TEFLON®, such as those provided as an example of a halogenated pyrotechnic composition, are also considered a part of this class. A representative equation for the reaction of torch and flare compositions is $$5Mg+2NaNO_3 \rightarrow 5MgO+Na_2+N_2.$$

Formulas and properties of some representative torch/flare compositions are provided in TABLE 5 for illustration purposes only.

TABLE 5.

REPRESENTATIVE TORCH/FLARE COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 58.0 Mg + 42.0 $NaNO_3$ | 2832 | 1621 | 3112 | 1.92 |
| 30.0 Mg + 30.0 Ba-$(NO_3)_2$ + 10.0 $KClO_4$ + 1.0 VAAR | 2972 | 638 | 1608 | 2.52 |
| 40.0 Mg + 35.0 Ba-$(NO_3)_2$ + 10.0 $KClO_4$ + 15.0 CuO | 2832 | 570 | 1942 | 3.41 |
| 24.0 Zr + 34.0 Si + 16.0 $Fe_2O_3$ 24.0 $KClO_4$ + 2.0 N $SiO_3$ | 2260 | 1020 | 2550 | 2.50 |

Igniter compositions, which are typically used in the ignition train of many pyrotechnic devices to enable or enhance ignition of the main charge, have a high heat output that also makes them suitable for use in the heat transfer delay. These mixtures often contain a metallic fuel mixed with a perchlorate oxidizer. Representative reactions for this group of compositions include $$2Zr+KClO_4 \rightarrow 2ZrO_2+KCl, \text{ and}$$

$$2Ti+KClO_4 \rightarrow 2TiO_2+KCl.$$

Formulas and properties of some representative igniter compositions are provided in TABLE 6 for illustration purposes only.

TABLE 6

REPRESENTATIVE IGNITER COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 24.5 B + 74.5 $KClO_4$ + 1.0 VAAR | 1866 | −659 | −1595 | 2.43 |
| 65.0 Zr + 25.0 $Fe_2O_3$ + 10.0 Diatomaceous Earth + 1.0 VAAR | 2440 | −4888 | −4815 | 1.67 |
| 50.0 Zr + 50.0 $KClO_4$ | 3699 | −568 | −2050 | 3.61 |
| 50.0 Al + 50.0 $KClO_4$ | 3331 | −827 | −2158 | 2.61 |
| 50.0 Ti + 50.0 $KClO_4$ | 3435 | −653 | −2108 | 3.23 |
| 49.0 B + 49.0 $KNO_3$ + 2.0 Binder | 2297 | −651 | −1412 | 2.17 |

Intermetallics are pyrotechnics that generate large amounts of heat with little or no gas generation. The energy released by intermetallics is derived from the alloying process, which involves the forming of new metal-metal bonds that are at a lower energy state than the pure metals. Representative reactions for this group of compositions include $2B+Ti \rightarrow B_2Ti$, $2B+Zr \rightarrow B_2Zr$, and $Al+Ni \rightarrow AlNi$.

Formulas and properties of some representative intermetallic compositions are provided in TABLE 7 for illustration purposes only.

TABLE 7

REPRESENTATIVE INTERMETALLIC COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 47.1 B + 52.9 Mg | 1433 | −479 | −972 | 2.03 |
| 55.5 Al + 45.5 B | 979 | −742 | −1940 | 2.61 |
| 19.2 B + 80.8 Zr | 3400 | −683 | −3360 | 4.93 |
| 31.5 Al + 68.5 Ni | 1637 | −330 | −1710 | 5.17 |
| 28.2 B + 71.8 Mn | 1113 | −294 | −1390 | 4.73 |
| 18.4 B + 81.6 Mo | 1260 | −196 | −1280 | 6.1O |
| 18.4 B + 81.6 Ti | 3225 | −1320 | −5170 | 3.60 |
| 12.8 B + 87.2 W | 960 | −83.0 | −1350 | 10.37 |

Preferably, the pyrotechnic material used for the pyrotechnic heat source is one of a mixture of titanium, amorphous boron, and barium chromate, most preferably about 46.67 percent by weight titanium, about 23.33 percent by weight amorphorous boron, and about 30 percent by weight barium chromate, or a mixture of tungsten, barium chromate, potassium perchlorate, and vinyl alcohol acetate resin, most preferably about 45 weight percent tungsten, about 40.5 weight percent barium chromate, about 14.5 weight percent potassium perchlorate, and about 1 weight percent vinyl alcohol acetate resin.

With regard to the autoignition material, 6, for the purpose of this invention, the terms "autoignition material" and "AIM" refer to any material that ignites without an external ignition source when its temperature is raised above a certain threshold temperature, i.e., its ignition or autoignition temperature, which is preferably less than about 250° C. Therefore, the autoignition material may be any material that will autoignite, preferably without detonating, when the heat from the pyrotechnic heat source, 5, is transmitted through the thermal choke, 7, to the autoignition material, 6, raising the temperature of the autoignition material, 6, to or above its autoignition temperature useful autoignition materials that autoignite in the range of 175-225° C., and are preferably non-detonating, include nitrocellulose, nitroglycerine based smokeless gun powders, safety and strike anywhere match compositions, smoke compositions, friction primer compositions, plastic bonded starter compositions, white smoke compositions, sugar based compositions and diazidodinitrophenol (DDNP) compositions. However, the most preferred non-detonating autoignition materials are mixtures of an oxidizer composition and a powdered metal fuel, such as the autoignition materials disclosed in U.S. patent application Ser. No. 08/791,176, filed Jan. 30, 1997, now U.S. Pat. No. 5,739,460, in U.S. patent application Ser. No. 08/645,945, filed May 14, 1996, and in U.S. patent application Nos. 09/010,822 and 09,010,823, filed Jan. 22, 1998, the contents of which are incorporated herein by reference to the extent necessary to supplement this specification.

Oxidizer compositions useful with powdered metal fuels in the non-detonating autoignition materials useful in the invention include, but are not limited to, compositions comprising alkali metal nitrates, alkaline earth metal nitrates, complex salt nitrates, dried, hydrated nitrates, silver nitrate, alkali metal chlorates, alkali metal perchlorates, alkaline earth metal chlorates, alkaline earth metal perchlorates, ammonium perchlorate, ammonium nitrate, sodium nitrite, potassium nitrite, silver nitrite, complex salt itrites, solid organic nitrates, solid organic nitrites, solid organic amines, and mixtures and comelts thereof Preferred oxidizers include silver nitrate and mixtures and comelts comprising at least one of silver nitrate or ammonium nitrate and at least one of an alkali metal or an alkaline earth metal nitrate, ammonium nitrate, a complex salt nitrate, such as $Ce(NH_4)_2(NO_3)_6$ or $ZrO(NO_3)_2$, a dried, hydrated nitrate, such as $Ca(NO_3)_2.4H_2O$ or $Cu(NO_3)_2.2.5H_2O$, an alkali or alkaline earth metal chlorate or perchlorate, ammonium perchlorate, a nitrite of sodium, potassium, or silver, a solid organic nitrate, nitrite, or amine, such as guanidine nitrate, nitroguanidine and 5-aminotetrazole, respectively.

Powdered metal fuels useful in the invention include, but are not limited to, molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, and silicon, where molybdenum is the most preferred.

Examples of useful non-detonating autoignition materials and their ignition temperatures are provided in TABLE 8 for illustration purposes only. Similarly, a series of nitrate based non-detonating autoignition materials is provided in TABLE 9 for illustration purposes only.

TABLE 8

REPRESENTATIVE NON-DETONATING AUTOIGNITION COMPOSITIONS

| Formula (%, wt/wt) | Autoignition Temperature (° C.) |
|---|---|
| Strike anywhere match mix<br>11.0 animal glue + 4.0 starch + 32.0 potassium chlorate + 6.0 zinc oxide + 10.0 phosphorus sesquisulfide ($P_4S_3$) + 33.0 powdered glass + 4.0 rosin | 120–150 |
| Safety match mix<br>11.0 animal glue + 5.0 sulfur + 51.0 potassium chlorate + 7.0 zinc oxide + 4.0 manganese dioxide + 15.0 powdered glass + 1.0 potassium dichromate + 6.0 black iron oxide ($Fe_3O_4$) | 180–200 |
| Smoke mix<br>43.5 hexachloroethane + 46.5 zinc oxide + 10.0 aluminum | 167 |
| Friction primer mix<br>42.0 potassium chlorate + 42.0 antimony sulfide + 3.0 sulfur + 2.0 calcium carbonate + 3.0 meal powder + 3.0 ground glass + 5.0 gum arabic | 139 |
| Friction primer mix<br>53.0 potassium chlorate + 22.0 antimony sulfide + 9.0 sulfur + 1.0 calcium carbonate + 10.0 ground glass + 5.0 gum arabic | 137 |
| Friction primer mix<br>63.0 potassium chlorate + 32.0 antimony sulfide + 5.0 gum arabic | 152 |
| Plastic bonded starter mix<br>39.0 potassium chlorate + 9.0 sodium bicarbonate + 3.0 acra-wax-filler + 5.0 synthesizer-plasticizer glass 22.0 NG + 845 Polymerecaptin crosslinker + 22.0 XD 2679 Resin | 150 |
| White smoke mix<br>44.0 hexachlorethane + 47.0 zinc oxide + 9.0 aluminum powder | 167 |
| Sugar based non-detonating autoignition material<br>73.6 potassium chlorate + 13.2 α-D Glucose + 13.2 sucrose | 140–160 |
| Match mix non-detonating autoignition material<br>50.0 potassium chlorate + 24.5 silica flour + 11.0 animal glue + 5.0 sulfur + 6.0 diatomaceous earth + 3.0 calcium carbonate + 0.5 potassium dichrornate | 160 |
| Diazidodinitrophenol (DDNP) non-detonating autoignition material<br>100 diazidodinitrophenol | 180 |
| DDNP based non-detonating autoignition material<br>~100 diazidodinitrophenol + trace phenol | <180 |

TABLE 9

REPRESENTATIVE NITRATE BASED NON-DETONATING AUTOIGNITION COMPOSITIONS

| Formula (%, wt/wt) | Autoignition Temperature (° C.) |
|---|---|
| 23.5 potassium nitrate + 39.4 silver nitrate + 37.1 molybdenum | 131–135 |
| 24.75 guanidine nitrate + 34.65 silver nitrate + 1.0 fumed silica + 39.6 molybdenum | 145–165 |
| 24.75 guanidine nitrate + 20.4 silver nitrate + 14.25 potassium nitrate + 1.0 fumed silica + 39.6 molybdenum | 123–126 |
| 13.5 guanidine nitrate + 16.5 lithium nitrate + 28.0 ammonium perchlorate + 2.0 fumed silica + 40.0 molybdenum | 165–170 |
| 62.0 ammonium nitrate + 28.0 guanidine nitrate + 10.0 molybdenum | 155 |
| 52.0 ammonium nitrate + 11.5 guanidine nitrate + 11.5 nitroguanidine + 25.0 molybdenum | 155 |
| 66.5 ammonium nitrate + 8.5 Tetramethylammonium nitrate + 25.0 molybdenum | 120–130 |
| 69.6 ammonium nitrate + 17.0 guanidine nitrate + 3.4 Tetramethylammonium nitrate + 10.0 molybdenum | 120–130 |
| 20.8 ammonium nitrate + 20.8 5-aminotetrazole + 43.4 potassium chlorate + 15.0 molybdenum | 110–120 |
| 23.0 ammonium nitrate + 23.0 5-aminotetrazole + 39.0 potassium perchlorate + 15.0 molybdenum | 160–170 |
| 31.3 ammonium nitrate + 15.6 barbituric acid + 38.1 potassium chlorate + 15.0 molybdenum | 80–90 |
| 34.1 ammonium nitrate + 17.1 barbituric acid + 33.8 potassium perchlorate + 15.0 molybdenum | 170–180 |

Any of a variety of materials can be used for the heat transfer medium for the thermal choke, 7, provided that they are not combustible, and transfer heat at a known rate. Useful materials include pure metals, alloys, ceramics, aluminas, silicas, alumina silicates, alumina borates, alumina silica borates, alumina nitrides, beryllias, carbides, composites, fiberglass, and graphite, with 316 Stainless Steel, which contains 18 percent chromium, 11 percent nickel, 2.5 percent molybdenum, no more than 0.1 percent carbon, with the balance iron, and Hastalloy Alloy C, which contains 16 percent molybdenum, 16 percent chromium, 5 percent iron, 4 percent tungsten, with a balance of manganese and silicon, being most preferred. It is also important to note that the materials used to make the thermal choke portion of the delay are not necessarily the same as those used to hold the pyrotechnic heat source or the autoigriition material. For example, the side walls of the pyrotechnic chamber may be stainless steel, the thermal choke might consist of graphite or copper while the autoignition material chamber is constructed of fiberglass. Moreover, The materials suitable for the thermal choke are essentially limitless. Metal alloys can be varied to achieve desired thermal properties depending upon the desired application. An extensive listing of possible materials can be found in Table 23–5 (Properties of Metals and Alloys) of Perry and Chilton's *Chemical Engineers'Handbook*, Fifth Edition, pp. 23–8 through 13–53, McGraw Hill, 1973, the teachings of which are incorporated herein to the extent necessary to supplement this disclosure. Similarly, depending upon the application, the thermal properties of ceramics and composites can tailored by one skilled in the art to obtain the desired delay time and thermal output.

Preferably, heat loss is controlled by surrounding the heat transfer medium and, in particular, the thermal choke, with an insulating material. The insulating material, 9, is preferably one that will absorb a minimum amount of heat, and, thus, prevent a loss of heat to the surroundings, resulting in substantially all of the heat from the combustion or reaction of the pyrotechnic heat source being transferred through the thermal choke to the autoignition material. Preferably, the insulating material is any of ceramics, filled epoxy resins, glasses, composite, including paints and laminates, non-heat-conductive polymers, expanded polytetrafluoroethylene (PFTE), e.g., GORE-TEX® and TEFLON®, natural and synthetic rubbers, urethanes, and heat resistant composites such as those used as liners for propellants. Particularly useful insulating materials include glass tape, polyethylene, epoxies, expanded TEFLON®, and PTFE.

The delay time of the heat transfer delay, defined as total time from the ignition of the pyrotechnic heat source to the ignition of the autoignition material, is a function of the chemical, physical, and ballistic properties of the components of the heat transfer delay. These include, the heat generated by the combustion or reaction of the pyrotechnic heat source, the nature of the heat transfer medium, including its thermal conductivity and heat loss to the surroundings, and the autoignition temperature of the autoignition material.

The delay time may be adjusted and determined by varying any of the components of the heat transfer delay. For example, varying the type and amount of the pyrotechnic heat source, within the constraints determined by the heat transfer control medium and autoignition of the autoignition material, determines the amount of heat transferred to the heat transfer medium, where the rate of heat transfer between the two materials is determined by the temperature difference between the two materials.

The nature of the heat transfer mechanism may also be altered to control the rate of heat transfer to the autoignition material and, thus, to determine the time delay.

Properties of the heat transfer mechanism that can be varied include the material used to form the thermal choke, e.g., pure metal, alloy, ceramic, etc., and the configuration of the thermal choke, including its length, mass, shape of the connection between the pyrotechnic heat source and the autoignition material, and the amount and nature of any insulating material employed.

The autoignition temperature of the autoignition material is also a factor in determining the delay. Clearly, the lower the autoignition temperature of the autoignition material, the shorter the delay time will be, as the autoignition temperature of the autoignition material is simply dependent upon reaching a temperature of at least the autoignition temperature of the autoignition material.

The various significant adjustable parameters of the thermal delay and the effects on the delay time relative to those adjustments are shown in TABLE 10.

TABLE 10

VARIABLE EFFECTS ON IGNITION TIME

| | | EFFECT ON DELAY TIME WHEN PROPERTY | |
|---|---|---|---|
| COMPONENT | PROPERTY | DECREASED | INCREASED |
| Pyrotechnic Heat Source | | | |
| Material | Heat of Reaction | Increased | Decreased |
| Material | Density | Increased | Decreased |
| Autoignition Material | Autoignition Temperature | Decreased | Increased |
| Thermal Choke | | | |
| Material | Specific Heat | Decreased | Increased |
| Material | Thermal Conductivity | Increased | Decreased |
| Configuration | Cross Sectional Area | Increased | Decreased |
| Configuration | Distance between pyrotechnic and MM | Decreased | Increased |
| Configuration | Total Mass | Variable | Variable |
| Insulation Material | Thermal Conductivity | Increased slightly | Decreased slightly |

The effects listed in Table 10 may be generalized as follows: the delay time is decreased when: (1) the amount of heat released by the combustion or reaction of the pyrotechnic heat source is increased, such as by using a pyrotechnic heat source having a higher heat of reaction and/or by increasing the amount of the pyrotechnic heat source; (2) the autoignition material is replaced with an autoignition material having a lower autoignition temperature; (3) the efficiency of the transfer of heat through the thermal choke to the autoignition material is improved, such as by increasing the cross sectional area of the thermal choke, shortening the length of the thermal choke, i.e, the distance the heat must travel to ignite the autoignition material, and/or by using a material having a higher thermal conductivity for the thermal choke.

Conversely, the delay time is increased when: (1) the amount of heat generated by the pyrotechnic is decreased, such as by using a pyrotechnic heat source having a lower heat of reaction and/or by decreasing the amount of the pyrotechnic heat source; (2) the autoignition material is replaced with an autoignition material having a higher autoignition temperature; (3) the transfer of heat through the thermal choke to the autoignition material is decreased, such as by decreasing the cross sectional area of the thermal choke, increasing the length of the thermal choke, and/or by using a material having a lower thermal conductivity for the thermal choke.

Changes in variables that affect the removal of heat generated by the pyrotechnic from the heat transfer delay, such as the specific heat of the choke material or of the insulation material, will also influence the delay time. When the heat losses are high, less of the heat generated by the combustion or reaction of the pyrotechnic heat source travels through the thermal choke to the autoignition material, and as a result, the amount of time required for the autoignition material to be heated to its autoignition temperature is increased. In contrast, where heat losses are reduced, the delay time is also reduced. It is important to note that as the delay time is increased, heat losses to the surroundings become more critical, and insulating techniques become important.

Figure 7:
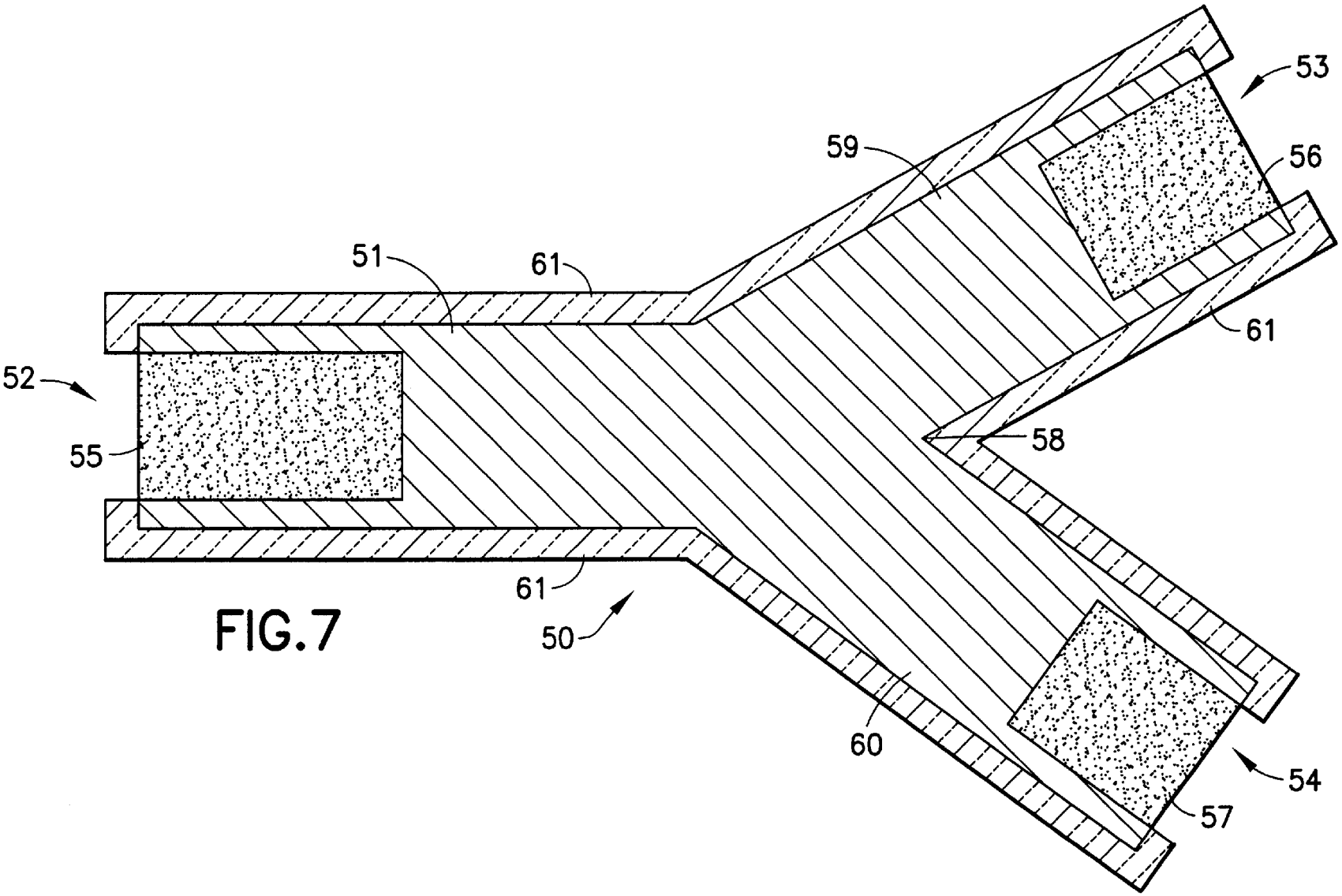
FIG. 7 is a cross sectional illustration of one embodiment of a multiple-functioning heat transfer delay of the invention

Multiple functioning delays and sequential delays can also be provided with the present invention. Multiple functioning delays may be obtained, e.g., by branching the heat transfer bridge of the delay as shown in FIG. 7. Delay 50, as shown in FIG. 7, comprises a housing 51 formed from a thermally conductive material, and defines cavities 52, 53, and 54, which contain a pyrotechnic heat source material 55 and autoignition materials 56 and 57. The housing is branched at 58, forming branches 59 and 60, and is optionally covered with a layer of insulating material 61. Upon ignition, heat source 55 produces heat that is transmitted through the housing 51 and branches 59 and 60, heating autoignition materials 56 and 57 to their autoignition temperature. As will be understood by one of skill in the art, autoignition materials 56 and 57 may be ignited virtually simultaneously by using the same autoignition material in each of cavities 53 and 54, where branch 59 has the same length as branch 60. In the alternative, two different autoignition materials, having different autoignition temperatures, and/or branches 59 and 60 may have different lengths and/or be formed from materials having different thermal conductivities, so that the autoignition materials do not ignite simultaneously.

Figure 8:
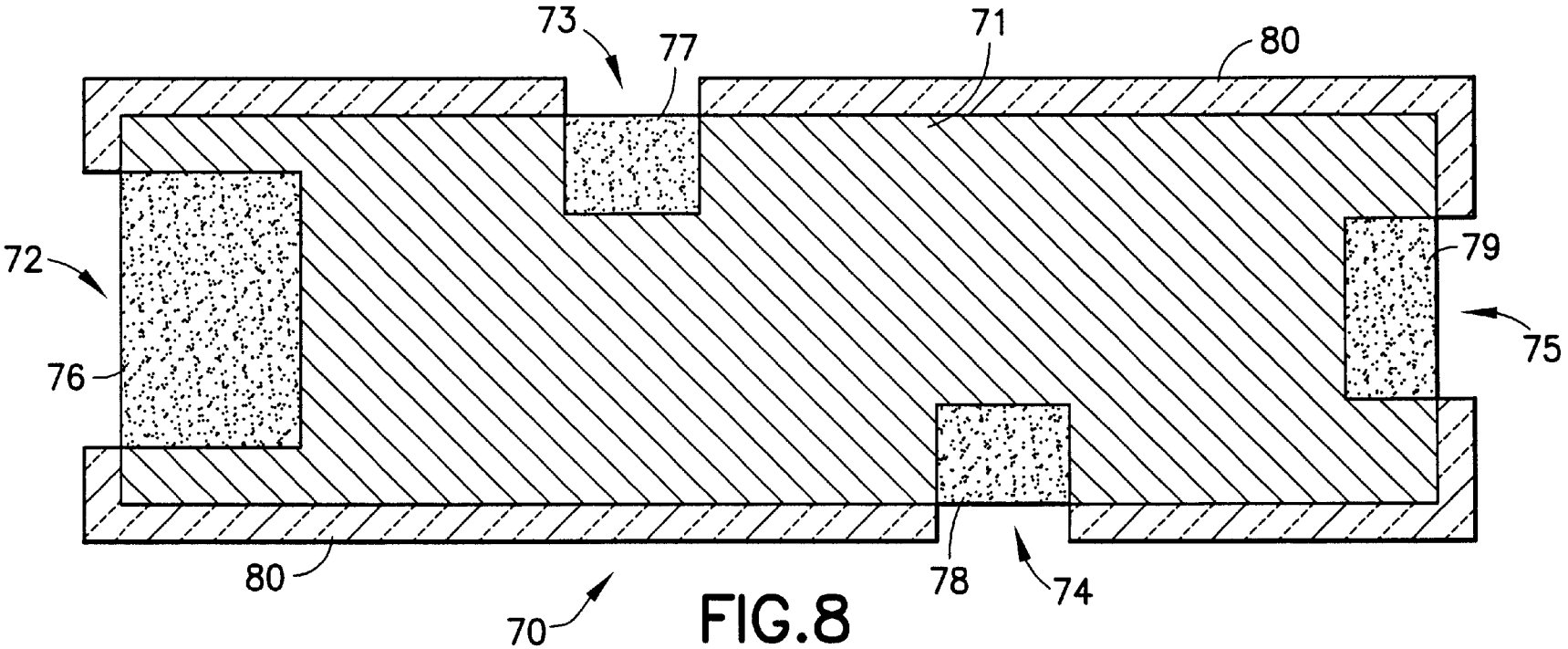
FIG. 8 is a cross sectional illustration of a further embodiment of a multiple-functioning heat transfer delay of the invention.

Alternatively, as shown in FIG. 8, a delay 70, having an unbranched housing 71 and multiple cavities 72, 73, 74, and 75 may be used. The housing 71 is optionally covered with a layer of insulating material 80. The pyrotechnic heat source material 76 may be placed in any of the cavities, and an autoignition material 77, 78, 79, which may be the same or different, is placed into the other cavities. Upon ignition of heat source 76, the heat produced is transmitted through the housing 71, which acts as the heat transfer control medium, heating the autoignition materials 77, 78, and 79 to their autoignition temperature, igniting each autoignition material. As will be understood by one of ordinary skill in the art, the position of the cavities 72, 73, 74, and 75 and the autoignition materials 73, 74, and 75 may be chosen so that the functioning of the autoignition materials is simultaneous or sequential. The timing of the functioning of each autoignition material in a delay may also be controlled by placing the autoignition material in a thermally conductive cup (not shown) that is inserted into any of the cavities. If cups having different thermal conductivities are used with either of the delays 50 and 70 shown in FIGS. 7 and 8, the delay time for the functioning of each autoignition material can be further controlled.

As will also be understood by one of skill in the art, multiple functioning delays in accordance with the invention are not limited to those shown in the Figures, which are for illustrative purposes only. Other multifunctioning delays may be, e.g., obtained using the basic delays shown in the other Figures.

In addition, the output of one delay may be used to ignite the pyrotechnic heat source of one or more other delays, by placing the output of the first delay sufficiently close to the heat source of the other delay or delays, such that, upon functioning, the output of the first delay ignites the heat source of the other delay or delays. Placing two or more delays sequentially in this manner allows delay time longer than could be obtained with a single delay.

The heat transfer delay of the invention is most useful when the size of the delay is critical due to space limitations, which accentuates the critical aspects of the performance of the chemical components. The use of a high heat output pyrotechnic and a low temperature autoignition material provide a broad range of heat transfer options and delay times, as demonstrated by the following non-limiting examples.

EXAMPLES

The following non-limiting examples are merely illustrative of the preferred embodiments of the present invention, and are not to be construed as limiting the invention, the scope of which is defined by the appended claims.

A prototype heat transfer delay similar to that shown in FIG. 1 was made from a 1 inch long stainless steel cylinder, having a 0.375 inch outer diameter (OD) by drilling a 0.25 inch diameter cavity at each end of the cylinder. The cavity for the pyrotechnic heat source was approximately 0.5 inch deep, and the cavity for the autoignition material was approximately 0.125 inch deep. Thus, the pyrotechnic heat source and the autoignition material were separated by approximately 0.125 inch of stainless steel.

The heat transfer delay was prepared by placing 0.1553 grams of an autoignition material, comprising potassium nitrate, silver nitrate, and molybdenum powder, i.e., 23.5% $KNO_3$, 39.4% $AgNO_3$, and 37.1% Mo, and having an autoignition temperature of 131° C., into the autoignition material cavity. Similarly, 0.6119 grams of a powder containing 60 weight percent magnesium (Mg), 35 weight percent TEFLON®, and 15 weight percent VITON® was placed into the pyrotechnic heat source cavity. Each end of the heat transfer delay was sealed with adhesive-backed aluminized Mylar film. A small electric match was placed over the end of the assembly containing the pyrotechnic heat source, and the electric match was sealed into position with additional Mylar film.

The heat of reaction of the pyrotechnic material used for the heat source was 1124 cal/g, and, thus, the 0.6119 grams of pyrotechnic material was sufficient to generate 687.8 calories upon combustion. Assuming that all 687.8 calories generated by the pyrotechnic was transferred to the heat transfer delay with no loss of heat to the surroundings, the temperature of the stainless steel heat transfer delay would increase by 218.4° C., which would be more than sufficient to ignite the autoignition material when the heat transfer delay was at ambient temperature. Therefore, a sufficient amount of heat was available to heat the autoignition material to at least its autoignition temperature.

The assembly was placed into the center of a 1.25 inch long CYCOLAC®, an acrylonitrile-butadiene-styrene (ABS) thermoplastic resin, tube having a 0.5 inch ID with a notch cut in the edge to allow placement of the electric match wires. The autoignition material containing end of the assembly was placed flush with the non-notched end of the CYCOLAC® tube and sealed into place with additional Mylar. An insulating material, i.e., 1.998 grams of Dow 93-104 Silicone RTV, prepared according to vendor directions, was injected into the space between the heat transfer delay and the CYCOLAC® tube, but not over the top the autoignition material. An additional 0.5545 g of Dow 93-104 was placed over the match to completely seal the pyrotechnic end of the heat transfer delay. The complete assembly or heat transfer delay was placed in a 75° C. oven for 30 minutes to initiate the curing of the Dow 93-104, and then stored at ambient temperature for approximately 66 hours.

The heat transfer delay was mounted in a clamp on a ring stand behind a plexiglass shield at an ambient temperature of 21° C. The wires of the electric match were attached to a DC power source, igniting the electric match, which, in turn, ignited the pyrotechnic heat source. A stopwatch was started with the ignition of the electric match. The pyrotechnic, ignited by the electric match, burned for approximately 2 seconds, and the autoignition material ignited 14.4 seconds after the ignition of the electric match.

The heat transfer was very efficient, as indicated by the ignition of the autoignition material, which was rapidly heated to its autoignition temperature, and clearly demonstrates that a delayed ignition of an autoignition material can be provided by the transfer of heat generated by the combustion of a pyrotechnic heat source through a heat flow controlling barrier or thermal choke. As discussed above, the delay time of 14.4 seconds can be adjusted by increasing or decreasing the rate of heat flow from the pyrotechnic heat source to the autoignition material, such as by changing the diameter of the connection formed by the thermal choke between the pyrotechnic heat source and the autoignition material, thereby changing the time required for heat to transfer and raise the temperature of the autoignition material to its ignition threshold. The results of similar experiments in which the various parameters, as are discussed above, are given in TABLE 11 and TABLE 12. The compositions of the pyrotechnic heat sources, autoignition materials, ignition boosters, and inhibitor used in the examples are as follows, where VAAR is vinyl alcohol acetate resin, and Cab-O-Sil M5 is fused silica:

45.0% W, 40.5% $BaCrO_4$, 14.5% $KClO_4$, 1.0% VAAR Formula1

23.5% $KNO_3$, 39.4% $AgNO_3$, 37.1% Mo Formula2

24.75% $Ch_6N_4O_3$, 34.65% $AgNO_3$, 1.0% Cab-O-Sil M5, 39.6% Mo Formula3

20.4% $AgNO_3$, 14.25% $KNO_3$, 24.75% $CH_6N_4O_3$, 1.0% Cab-O-Sil M5, 39.6% Mo Formula4

91.5% R45M, 84.7% IPDI, 0.1% TPB, 1.0% DOZ+Dibutyl Tin Dilaurate Formula5

65% Zr, 25% $Fe_2O_3$, 10% Diatomaceous Earth, 1% VAARormula6

16.5% $LiNO_3$, 13.5% $CH_6N_4O_3$, 28.0% $NH_4ClO_4$, 2.0% Cab-O-Sil M5, 40.0% Mo Formula7

81.6% Ti, 18.4% B Formula8

24% Zr, 34% Si, 16% $Fe_2O_3$, 24% $KClO_4$, 2% $Na_2SiO_3$ Formula9

46.67% Ti, 23.33% amorphous B, 30.0% $BaCrO_4$ Formula10

44.2% Ti, 13.3% B, 42.5% $KClO_4$ Formula11

TABLE 11

HEAT TRANSFER SYSTEM EXAMPLES

| System Number | 1 | 2 | 3 | 4 | 5 |
|---|---|---|---|---|---|
| HTD Material | 316 Stainless Steel | 316 Stainless Steel | 316 Stainless Steel | 316 Stainless Steel | 316 Stainless Steel |
| HTD Dimensions: | 1.00" × 0.250" | 1.00" × 0.250" | 1.00" × 0.250" | 1.00" × 0.250" | 1.00" × 0.250" |
| Pyro Cavity: | 0.625" × 0.0625" | 0.625" × 0.0625" | 0.625" × 0.0625" | 0.500" × 0.0625" | 0.500" × 0.0625" |
| AIM Cavity: | 0.125" × 0.0625" | 0.125" × 0.0625" | 0.125" × 0.0625" | 0.125" × 0.0625" | 0.125" × 0.0625" |
| Choke: | 0.250" × 0.125" | 0.125" × 0.125" | 0.125" × 0.0625 | 0.375" × 0.250" | 0.250" × 0.125" |
| Insulation: | Glass Tape | Glass Tape | Glass Tape | Glass Tape | Glass Tape |
| Heat Source: | (Form. 1) | (Form. 1) | (Form. 1) | (Form. 1) | (Form. 1) |
| Ignition Booster: | None | None | None | None | None |
| AIM | (Form. 2) | (Form. 2) | (Form. 2) | (Form. 2) | (Form. 2) |
| Test Temperature | 75° F. | 75° F. | 75° F. | 75° F. | 75° F. |
| Time to Auto-ignition: | 30 sec. | 39 sec. | 57 sec. | 64 sec. | 54 sec. |

| System Number | 6 | 7 | 8 | 9 | 10 |
|---|---|---|---|---|---|
| HTD Material | 316 Stainless Steel | Hastalloy Alloy C | Hastalloy Alloy C | Hastalloy Alloy C | 316 Stainless Steel |
| HTD Dimensions: | 1.00" × 0.250" | 1.00" × 0.250" | 1.00" × 0.250" | 1.00" × 0.250" | 1.00" × 0.188" |
| Pyro Cavity: | 0.625" × 0.0625" | 0.500" × 0.188" | 0.500" × 0.188" | 0.500" × 0.188" | 0.500" × 0.156" |
| AIM Cavity: | 0.125" × 0.0625" | 0.200" × 0.188" | 0.200" × 0.188" | 0.200" × 0.188" | 0.200" × 0.156" |
| Choke: | 0.250" × 0.250" | 0.250" × 0.250" | 0.250" × 0.250" | 0.250" × 0.250" | 0.250" × 0.188" |
| Insulation: | Glass Tape | Poly-ethylene Tubing | Epoxy | Inhibitor (Form. 5) | Expanded Teflon ® |
| Heat Source: | (Form. 1) | (Form. 1) | (Form. 1) | (Form. 1) | (Form. 1) |
| Ignition Booster: | None | None | None | None | (Form. 6) |
| AIM | (Form. 3) | (Form. 4) | (Form. 4) | (Form. 4) | (Form. 4) |
| Test Temperature | 75° F. | 75° F. | 75° F. | 75° F. | 75° F. |
| Time to Auto-ignition: | 58 sec. | 81 sec. | 27 sec. | 38 sec. | 19 sec. |

TABLE 12

HEAT TRANSFER DELAY SYSTEM EXAMPLES

| System Number | 11 | 12 | 13 | 14 | 15 |
|---|---|---|---|---|---|
| HTD Material | 316 Stainless Steel | 316 Stainless Steel | 316 Stainless Steel | 316 Stainless Steel | 316 Stainless Steel |
| HTD Dimensions: | 1.00" × 0.188" | 1.00" × 0.188" | 1.00" × 0.188" | 1.00" × 0.188" | 1.00" × 0.188" |
| Pyro Cavity: | 0.500" × 0.156" | 0.500" × 0.156" | 0.500" × 0.156" | 0.500" × 0.156" | 0.500" × 0.159" |
| AIM Cavity: | 0.200" × 0.156" | 0.200" × 0.156" | 0.200" × 0.156" | 0.200" × 0.156" | 0.200" × 0.159" |
| Choke: | 0.250" × 0.188" | 0.250" × 0.188" | 0.250" × 0.188" | 0.250" × 0.188" | 0.250" × 0.188" |
| Insulation: | Expanded Teflon ® | PTFE Tubing | PTFE Tubing | Expanded Teflon ® | Expanded Teflon ® |
| Heat Source: | (Form. 1) | (Form. 1) | (Form. 1) | (Form. 8) | (Form. 10) |
| Ignition Booster: | (Form. 6) | (Form. 6) | (Form. 6) | (Form. 9) | (Form. 1) |
| AIM | (Form. 7) | (Form. 4) | (Form. 7) | (Form. 4) | (Form. 4) |
| Test Temperature | 75° F. | 75° F. | 75° F. | 75° F. | 75° F. |
| Time to Auto-ignition: | 36 sec. | 25 sec. | 36 sec. | 22 sec. | 74 sec. |

| System Number | 16 | 17 | 18 | 19 |
|---|---|---|---|---|
| HTD Material | 316 Stainless Steel | 316 Stainless Steel | 316 Stainless Steel | 316 Stainless Steel |
| HTD Dimensions: | 1.00" × 0.188" | 1.00" × 0.188" | 1.00" × 0.188" | 1.00" × 0.188" |
| Pyro Cavity: | 0.500" × 0.159" | 0.500" × 0.159" | 0.500" × 0.159" | 0.500" × 0.159" |
| AIM Cavity: | 0.250" ∴ 0.159" | 0.250" ∴ 0.159" | 0.250" ∴ 0.159" | 0.250" ∴ 0.159" |
| Choke: | 0.200" × 0.188" | 0.250" × 0.188" | 0.200" × 0.188" | 0.200" × 0.188" |
| Insulation: | Expanded Teflon ® | Expanded Teflon ® | Expanded Teflon ® | Expanded Teflon ® |
| Heat Source: | (Form. 10) | (Form. 10) | (Form. 11) | (Form. 11) |
| Ignition Booster: | (Form. 1) | (Form. 1) | (Form. 9) | (Form. 9) |
| AIM | (Form. 4) | (Form. 4) | (Form. 4) | (Form. 7) |
| Test Temperature | −40° F. | +160° F. | 75° F. | 75° F. |
| Time to Auto-ignition: | 100 sec. | 83 sec. | 15 sec. | 25 sec. |

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

We claim:

1. A heat transfer delay for providing a delay time in propellant, pyrotechnic, and explosive devices, the delay comprising:

a housing, comprising a first heat source cavity and a second heat source cavity, and a heat transfer bridge connecting the first and second heat source cavities; a pyrotechnic heat source in thermal contact with the first heat source cavity, and a non-detonating autoignition material in thermal contact with the second heat source cavity; wherein upon ignition and combustion or reaction, the pyrotechnic heat source generates an amount of heat sufficient to heat the first heat source cavity to a temperature sufficiently high to cause a transfer of a sufficient amount of heat through the heat transfer bridge to the second heat source cavity to heat the cavity to a temperature sufficiently high to ignite the non-detonating autoignition material, and produce a non-detonating thermal output therefrom, and wherein the heat transfer bridge conducts heat at a rate such that a delay time of at least about 0.5 second elapses between ignition of the heat source and ignition of the non-detonating autoignition material.

2. The heat transfer delay of claim 1, wherein the autoignition material is selected from the group consisting of nitrocellulose, nitroglycerine based smokeless gun powders, safety and strike anywhere match compositions, smoke compositions, friction primer compositions, plastic bonded starter compositions, white smoke compositions, sugar based compositions, diazidodinitrophenol (DDNP) compositions, mixtures of an oxidizer composition and a powdered metal fuel, and mixtures thereof.

3. The heat transfer delay of claim 1, wherein the non-detonating autoignition material comprises a mixture of an oxidizer composition and a powdered metal fuel, and wherein the oxidizer composition is selected from the group consisting of alkali metal nitrates, alkaline earth metal nitrates, complex salt nitrates, dried, hydrated nitrates, silver nitrate, alkali metal chlorates, alkali metal perchlorates, alkaline earth metal chlorates, alkaline earth metal perchlorates, ammonium perchlorate, ammonium nitrate, sodium nitrite, potassium nitrite, silver nitrite, complex salt nitrites, solid organic nitrates, solid organic nitrites, solid organic amines, and mixtures and comelts thereof.

4. The heat transfer delay of claim 3, wherein the oxidizer composition is selected from the group consisting of silver nitrate, and mixtures and comelts of at least one of silver nitrate and ammonium nitrate and at least one of alkali metal nitrates, alkaline earth metal nitrates, ammonium nitrate, complex salt nitrates, dried, hydrated nitrates, alkali metal chlorates, alkali metal perchlorates, alkaline earth metal chlorates, alkaline earth metal perchlorates, ammonium perchlorate, nitrites of sodium, nitrites of potassium, nitrites of silver, solid organic nitrates, solid organic nitrites, and solid organic amines.

5. The heat transfer delay of claim 3, wherein the powdered metal fuel is selected from the group consisting of molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, silicon, and mixtures thereof.

6. The heat transfer delay of claim 1, wherein the non-detonating autoignition material is selected from the group consisting of mixtures of potassium nitrate, silver nitrate, and molybdenum; mixtures of guanidine nitrate, silver nitrate, fused silica, and molybdenum; mixtures of silver nitrate, potassium nitrate, guanidine nitrate, fused silica, and molybdenum; mixtures of lithium nitrate, guanidine nitrate, ammonium perchlorate, fused silica, and molybdenum; mixtures of ammonium nitrate, guanidine nitrate, and molybdenum; mixtures of ammonium nitrate, guanidine nitrate, nitroguanidine, and molybdenum; mixtures of ammonium nitrate, tetramethylammonium nitrate, and molybdenum; mixtures of ammonium nitrate, guanidine nitrate, tetramethylammonium nitrate, and molybdenum; mixtures of ammonium nitrate, 5-aminotetrazole, potassium chlorate, and molybdenum; mixtures of ammonium nitrate, 5-aminotetrazole, potassium perchlorate, and molybdenum; mixtures of ammonium nitrate, barbituric acid, potassium chlorate, and molybdenum; and mixtures of ammonium nitrate, barbituric acid, potassium perchlorate, and molybdenum.

7. The heat transfer delay of claim 1, wherein the pyrotechnic heat source is selected from the group consisting of thermites, thermates, delay compositions, halogenated compositions, torch/flare compositions, igniter compositions, intermetallic compositions, and mixtures thereof.

8. The heat transfer delay of claim 1, wherein a least a portion of the housing is formed from a material selected from the group consisting of metals, alloys, ceramics, aluminas, silicas, alumina silicates, alumina borates, alumina silica borates, alumina nitrides, beryllias, carbides, composites, fiberglass, and graphite.

9. The heat transfer delay of claim 1, wherein the heat transfer bridge serves as a thermal choke having a cross sectional area and a thermal conductivity that control the transfer of heat from the first heat source cavity to the second heat source cavity of the housing.

10. The heat transfer delay of claim 1, wherein the first heat source cavity defines a portion of the housing for containing the heat source.

11. The heat transfer delay of claim 1, wherein the second heat source cavity defines a portion of the housing for containing a non-detonating autoignition material.

12. The heat transfer delay of claim 1, further comprising an insulating material at least partially surrounding the housing to reduce or eliminate a loss of heat from the housing.

13. The heat transfer delay of claim 12, wherein the insulating material is selected from the group consisting of ceramics, filled epoxy resins, glasses, composites, paints, laminates, non-heat-conductive polymers, expanded polytetrafluoroethylene, natural and synthetic rubbers, urethanes, and heat resistant composites.

14. The heat transfer delay of claim 12, wherein the insulating material is glass tape, polyethylene, an epoxy, expanded polytetrafluoroethylene.

15. The heat transfer delay of claim 1, wherein the heat transfer bridge conducts heat at a rate such that a delay time of at least about 1 second elapses between ignition of the heat source and ignition of the non-detonating autoignition material.

16. The heat transfer delay of claim 1, wherein the heat transfer bridge conducts heat at a rate such that a delay time of at least about 10 seconds elapses between ignition of t he heat source and ignition of the non-detonating autoignition material.

17. The heat transfer delay of claim 1, wherein the heat transfer bridge conducts heat at a rate such that a delay time of at least about 30 seconds elapses between ignition of the heat source and ignition of the non-detonating autoignition material.

18. The heat transfer delay of claim 1, wherein the heat transfer bridge conducts heat at a rate such that a delay time of at least about 60 seconds elapses between ignition of the heat source and ignition of the non-detonating autoignition material.

19. The heat transfer delay of claim 1, wherein the heat transfer bridge conducts heat at a rate such that a delay time of at least about 90 seconds elapses between ignition of the heat source and ignition of the non-detonating autoignition material.

20. The heat transfer delay of claim 1, wherein the heat transfer bridge conducts heat at a rate such that a delay time of greater than about 90 seconds elapses between ignition of the heat source and ignition of the non-detonating autoignition material.

21. A method of delaying production of a non-detonating thermal output, the method comprising:

placing a heat transfer medium in thermal contact with a pyrotechnic heat source and a non-detonating autoignition material, the non-detonating autoignition material having an autoignition temperature;

igniting the pyrotechnic heat source, thereby producing heat from combustion or reaction of the pyrotechnic heat source;

transferring at least a portion of the beat of reaction to the heat transfer medium;

conducting at least a portion of this heat through the heat transfer medium to the non-detonating autoignition material;

raising the temperature of the non-detonating autoignition material with the heat to at least the autoignition temperature, and, thus, igniting the non-detonating autoignition material; and producing a non-detonating thermal output due to the ignition; wherein the heat transfer medium conducts heat at a rate such that a delay time of at least about 0.5 seconds elapses between ignition of the heat source and ignition of the non-detonating autoignition material.

22. The method of claim 21, further comprising insulating at least a portion of the heat transfer medium to prevent heat loss.

23. A method of delaying production of a non-detonating thermal output, the method comprising:

selecting a heat transfer medium having a thermal conductivity, a pyrotechnic heat source having a heat of reaction, and a non-detonating autoignition material having an autoignition temperature;

forming the heat transfer medium into a housing, which comprises a first heat source cavity, a second heat source cavity, and a heat transfer bridge, having a cross sectional area and a length, and connecting the first heat source cavity and the second heat source cavity;

placing an amount of the pyrotechnic heat source in thermal contact with the first heat source cavity, and the non-detonating autoignition material in thermal contact with the second heat source cavity;

igniting the pyrotechnic heat source, thereby producing heat from combustion or reaction of the pyrotechnic heat source;

transferring at least a portion of the heat of reaction to the heat transfer medium;

conducting at least a portion of this heat through the heat transfer medium to the non-detonating autoignition material;

raising the temperature of the non-detonating autoignition material with the heat to at least the autoignition temperature, and, thus, igniting the non-detonating autoignition material; and producing a non-detonating thermal output due to the ignition; wherein the heat transfer medium conducts heat at a rate such that a delay time of at least about 0.5 seconds elapses between ignition of the heat source and ignition of the non-detonating autoignition material.

24. The method of claim 23, further comprising insulating at least a portion of the heat transfer medium to prevent heat loss.

25. The method of claim 23, further comprising varying at least one of the cross sectional area, length, and thermal conductivity of the heat transfer portion, the amount and heat of reaction of the pyrotechnic heat source, the autoignition temperature of the non-detonating autoignition material to adjust the delay time to a desired duration.

26. The heat transfer delay of claim 1, further comprising an insulating material comprising expanded polytetrafluoroethylene, wherein the housing comprises stainless steel, the pyrotechnic heat source comprises titanium, amorphous boron, barium chromate, and a booster material comprising tungsten, barium chromate, potassium perchlorate, and vinyl alcohol acetate resin, and the non-detonating autoignition material comprises guanidine nitrate, silver nitrate, molybdenum, and fumed silica.

27. The method of claim 23, further comprising insulating the housing with an insulating material comprising expanded polytetrafluoroethylene, selecting stainless steel as the heat transfer medium, selecting a composition comprising titanium, amorphous boron, barium chromate, and a booster material comprising tungsten, barium chromate, potassium perchlorate, and vinyl alcohol acetate resin as the pyrotechnic heat source, and selecting a composition comprising guanidine nitrate, silver nitrate, molybdenum, and fumed silica as the non-detonating autoignition material.

* * * * *